US009070257B1

(12) United States Patent
Scalise

(10) Patent No.: US 9,070,257 B1
(45) Date of Patent: Jun. 30, 2015

(54) SYSTEMS AND METHODS FOR BETTING POOLS

(71) Applicant: Russell Scalise, Chicago, IL (US)

(72) Inventor: Russell Scalise, Chicago, IL (US)

( * ) Notice: Subject to any disclaimer, the term of this patent is extended or adjusted under 35 U.S.C. 154(b) by 0 days.

(21) Appl. No.: 14/251,289

(22) Filed: Apr. 11, 2014

(51) Int. Cl.
*G07F 17/32* (2006.01)

(52) U.S. Cl.
CPC ..... *G07F 17/3288* (2013.01)

(58) Field of Classification Search
USPC ..... 463/26, 27, 28
See application file for complete search history.

(56) References Cited

U.S. PATENT DOCUMENTS

2014/0011561 A1* 1/2014 Lutnick et al. ..... 463/17
2014/0206439 A1* 7/2014 Tavano ..... 463/28
2014/0370958 A1* 12/2014 Lutnick ..... 463/17

* cited by examiner

*Primary Examiner* — Pierre E Elisca
(74) *Attorney, Agent, or Firm* — Sheppard, Mullin, Richter & Hampton LLP

(57) ABSTRACT

Various embodiments described herein provide systems and methods that establish a betting pool associated with a plurality of pool participants and associated with a plurality of real-life events scheduled to occur over a time period. For a first participant of the plurality of pool participants, the systems and methods may receive a first points wager on a first predicted outcome of a first real-life event of the plurality of real-life events, update the points balance in the points account based on the first points wager and on a first actual outcome of the first real-life event, receive a second points wager on a second predicted outcome of a second real-life event of the plurality of real-life events, and update the points balance in the points account based on the second points wager and on a second actual outcome of the second real-life event.

20 Claims, 6 Drawing Sheets

SYSTEMS AND METHODS FOR BETTING POOLS

BACKGROUND

1. Technical Field

Various embodiments of the present invention(s) relate to systems and methods for betting pools associated with a series of real-life events, such as sports matches.

2. Description of Related Art

Betting pools are common in modern society and are often established in connection with popular sporting championships (e.g., NCAA March Madness, FIFA World Cup, NFL Super Bowl, etc.) and fantasy sports. Such pools are generally established between friends, families, and coworkers (e.g., office pools) and require the participants of the betting pool to pay a fee to enter the pool. The collected entry fee usually serves as prize money for the betting pool winner or winners (e.g., $1^{st}$, $2^{nd}$ and $3^{rd}$ place winners). In this way, betting pools can incentivize public interest in following real-world and fantasy sporting activities.

With particular regard to fantasy sports and fantasy sports leagues, the use of a betting pool can encourage fantasy league participants to actively participate during a fantasy league season by providing the fantasy league participants with a chance to win some or all of money placed in the betting pool (e.g., money placed in the betting pool by each fantasy team owner as a fantasy league entry fee).

Generally, a fantasy sports league (hereafter, fantasy league) is established in connection with a particular real-world professional sports league (e.g., in the U.S. National Football League, Major League Baseball, Major League Soccer), and participants in the fantasy league act as owners a fantasy sports team (hereafter, a fantasy team) that create and manage within the fantasy league. Each fantasy team is composed of real-world players, which are selected by the fantasy team owner from the real-world professional sports league, often regardless of their real-world team affiliations. Generally, the fantasy league season lasts for the length of the regular season of the real-world professional sports league to which it is associated. During the fantasy league season, the performance of the fantasy team is determined by the real-world performance (e.g., statistical performance, points scored, etc.) of the real-world players on the fantasy team. Since real-world performance of an individual real-world player corresponds to player activity during real-world sports matches, during the fantasy league season, fantasy team owners actively manage their respective fantasy team rosters to maximize the performance their respective fantasy teams derive from the real-world sports matches that occur during the real-world regular sports season. At the end of the fantasy league season, the fantasy teams may be ranked (e.g., based on their respective overall performance) and one or more fantasy team owners may be declared winners of the league. Where there is a betting pool involved, the one or more winners of fantasy league may receive prize money from the betting pool.

Unfortunately, traditionally formatted fantasy sports leagues provide little or no opportunity for low-performing fantasy league participants to improve their overall standing once their fantasy team has fallen behind. It is common for fantasy league participants that are not performing too well during a fantasy sports season to lose interest as the fantasy league season progresses. Often, this leads to low-performing fantasy league participants reducing or ceasing their participation in the fantasy league's activities for the remainder of the fantasy league season.

SUMMARY OF EMBODIMENTS

Various embodiments described herein provide systems and methods for betting pools and, in particular, conducting betting pools in association with a set of real-life events, such as sports matches. For some embodiments, the systems and methods described herein can improve active participation of betting pool participants (hereafter, pool participants) through the duration of a set of real-life events. For example, where a betting pool is associated with a set of professional football matches scheduled to occur over a football season, systems and methods can increase the participation of betting pool participants, in betting pool activities, through the entirety of the football season.

In some embodiments, systems and methods facilitate a betting pool (e.g., office pool) where each pool participant begins with a predetermined balance of points, where pool participants wager their respective points on the predicted outcomes of one or more real-life events in a set of real-life events (e.g., results of one or more sports matches in a sports season), where pool participants earn or lose points based on their wagers and the actual outcomes of the real-life events, and where the pool participant with the most points at the end of the set of real-life events wins the betting pool. In certain embodiments, the systems and methods require each pool participant to make a forced points wager (hereafter, an ante) on each real-life event in the set of rea-life event (e.g., wager on each sports match in the sports season). In this way, various embodiments ensure that those pool participants who fail to remain active in the betting pool (e.g., actively wagering on the predicted outcomes of sports matches) are eventually eliminated (hereafter, anted-out) when their balance of points reaches minimum threshold of points (e.g., reaches zero or reaches a balance below the ante amount). The systems and methods may make the ante automatically for an individual pool participant (e.g., for one or more real-life events) if that pool participant fails to submit a wager or fails to submit a minimum wager before a particular time (e.g., before the individual real-life events begin).

According to some embodiments, systems and methods are provided that establish a betting pool associated with a plurality of pool participants and associated with a plurality of real-life events scheduled to occur over a time period. The system and methods may associate each participant of the plurality of pool participants with points in a points accounts. Using the points, each pool participant may submit points wagers for predicted outcomes of the plurality of real-life events scheduled to occur over the time period. In some embodiments, the points associated with each participant of the plurality of pool participants is initialized to a set amount.

For a first participant of the plurality of pool participants, the systems and methods may receive a first points wager on a first predicted outcome of a first real-life event of the plurality of real-life events, receive a first actual outcome for the first real-life event, and update the points balance in the points account based on the first points wager and on a first actual outcome of the first real-life event. Additionally, for the first participant of the plurality of pool participants, the systems and methods may receive a second points wager on a second predicted outcome of a second real-life event of the plurality of real-life events, receive a second actual outcome for the second real-life event, and update the points balance in the points account based on the second points wager and on a second actual outcome of the second real-life event. For some embodiments, one or more steps described above with respect to the first participant of the plurality of pool participants may be performed in parallel with one another. Eventually, the systems and methods may identify, from the plurality of pool participants, a set of pool participant winners (e.g., $1^{st}$, $2^{nd}$, and $3^{rd}$ place winners) based on the points associated with each participant of the plurality of pool participants. Such identification may occur at or after the time period for the plurality of real-life events has expired.

Depending on the embodiment, the first points wager may be for at least a first subset of the points in the points account, and the second points wager may be for at least a second subset of the points in the points account. For some embodiments, the first points wager is limited to the points in the points account when the first points wager is received, and the second points wager is limited to the points in the points account when the second points wager is received.

For some embodiments, updating the points in the points account, for the first participant of the plurality of pool participants, based on the first points wager and on the first actual outcome of the first real-life event comprises depositing points to or withdrawing deposits from the points account based on the first points wager by the first pool participant.

Depending on the embodiment, the plurality of real-life events can include real-life sports matches and the time period may correspond to a sports season associated with the real-life sports matches. The real-life sports matches may be associated with football, basketball, baseball, hockey, soccer, golf, tennis, or the like. Additionally, the real-life sports matches may be those associated with a real-life, professional sports league, such as the NFL, the NHL, FIFA, or the MLB. For some embodiments, the first real-life event is a first sports match, and the first predicted outcome and the first actual outcome may relate to a first winner of the first sports match, a first player performance of a first sports player participating in the first sports match, or a first team performance of a first team participating in the first sports match. Likewise, for some embodiments, the second real-life event is a second sports match, and the second predicted outcome and the second actual outcome may relate to a second winner of the second sports match, a second player performance of a second sports player participating in the second sports match, or a second team performance of a second team participating in the second sports match.

Depending on the embodiment, the first points wager or the second points wager may comprise an ante. In some embodiments, the first real-life event ends before the second real-life event begins, and the second points wager is based on the points in the points account after the updating the points in the points account based on the first points wager. Additionally, in some embodiments, the second real-life event begins substantially simultaneously to the first real-life event. Furthermore, in some embodiments, the second real-life event begins before the first real-life event ends.

For some embodiments, the first points wager is generated automatically if the participant fails to provide the first points wager for the first real-life event. For example, the systems and methods may require each participant of the plurality of pool participants to provide a minimum points wager (e.g., an ante) for each real-life event of the plurality of real-life events. The systems and methods may require each participant of the plurality of pool participants to provide a minimum points wager for a given real-life event before the given real-life event begins. Additionally, in the event that a given participant fails to provide a minimum points wager for a given real-life event before the given real-life event begins, the systems and methods may automatically generate the minimum points wager on behalf of the given participant. In this way, various embodiments ensure that each participant of the plurality of pool participants is wagering on the outcome of each real-life event of the plurality of the real-life events, and that those pool participants who fail to remain active in the betting pool are anted-out.

For some embodiments, the first points wager is generated automatically if the given pool participant fails to provide the first predicted outcome for the first real-life event. For example, the systems and methods may require each participant of the plurality of pool participants to provide a predicted outcome for each real-life event of the plurality of real-life events. The systems and methods may require each participant of the plurality of pool participants to provide a predicted outcome for a given real-life event before the given real-life event begins. Additionally, in the event that a given participant fails to provide a predicted outcome for a given real-life event before the given real-life event begins, the systems and methods may automatically generate the predicted outcome on behalf of the given participant (e.g., according to the given participants predefined preferences). In this way, various embodiments ensure that each participant of the plurality of pool participants is wagering on the outcome of each real-life event of the plurality of the real-life events.

For some embodiments, the systems and methods described herein can provide a new format for playing fantasy sports for a fantasy sports season. Depending on the embodiment, this new format can take the place of, or be used in conjunction with, traditional forms of playing fantasy sports (e.g., operating a fantasy sports league).

Additionally, though various embodiments described herein are done so with respect to betting pools, it will be understood that various embodiments need not be associated with real-world gambling. Indeed, various embodiments described herein can be readily utilized in conducting competition between two or more participants without need for wagering money or items of material value on the competition.

Some embodiments provide for a method that performs various steps and operations described herein, or provide for a computer program product comprising a computer readable medium having computer program code (i.e., executable instructions) executable by a processor to perform various steps and operations described herein. For example, the systems and methods described herein may be implemented, in whole or in part, as a microcontroller that operates in connection with a power amplifier.

BRIEF DESCRIPTION OF THE DRAWINGS

The drawings are provided for purposes of illustration only and merely depict typical or example embodiments. These drawings are provided to facilitate the reader's understanding and shall not be considered limiting of the breadth, scope, or applicability various embodiments.

The figures are not intended to be exhaustive or to limit the embodiments to the precise form disclosed. It should be understood that various embodiments may be practiced with modification and alteration.

DETAILED DESCRIPTION OF VARIOUS EMBODIMENTS

Various embodiments described herein provide systems and methods for betting pools and, in particular, conducting betting pools in association with a set of real-life events, such as sports matches (e.g., exhibition games, regular season games, championships, sports drafts) and awards shows (e.g., Academy Awards®, Golden Globes, Emmys, etc.). In particular embodiments, systems and methods manage or otherwise facilitate a betting pool, for two or more pool participants, where the betting pool is associated with a plurality of real-life events.

Various embodiments described herein encourage more pool participants to actively participate (e.g., daily or weekly basis) in the betting pools, particularly those pool participants that are behind in standing within the betting pool (e.g., those pool participants having a low points account balance). In particular, various embodiments enable pool participants to leverage their current standing (e.g., points accounts balance) to manage their risk with respect to each real-life event associated with the betting pool, which can further enable pool participants to risk it all (e.g., all their points), on any given real-life event associated with the betting pool, in order to advance their self in the betting pool standing.

In some embodiments, systems and methods facilitate a betting pool (e.g., office pool) where each pool participant begins with a predetermined balance of points, where pool participants wager their respective points on the predicted outcomes of one or more real-life events in a set of real-life events (e.g., results of one or more sports matches in a sports season), where pool participants earn or lose points based on their wagers and the actual outcomes of the real-life events, and where the pool participant with the most points at the end of the set of real-life events wins the betting pool. In certain embodiments, the systems and methods require each pool participant to make an ante on each real-life event in the set of rea-life event (e.g., wager on each sports match in the sports season). In this way, various embodiments ensure that those pool participants who fail to remain active in the betting pool (e.g., actively wagering on the predicted outcomes of sports matches) are eventually eliminated (anted-out) when their balance of points reaches minimum threshold of points (e.g., reaches zero or reaches a balance below the ante amount). The systems and methods may make the ante automatically for an individual pool participant (e.g., for one or more real-life events) if that pool participant fails to submit a wager or fails to submit a minimum wager before a particular time (e.g., before the individual real-life events begin).

Figure 1:
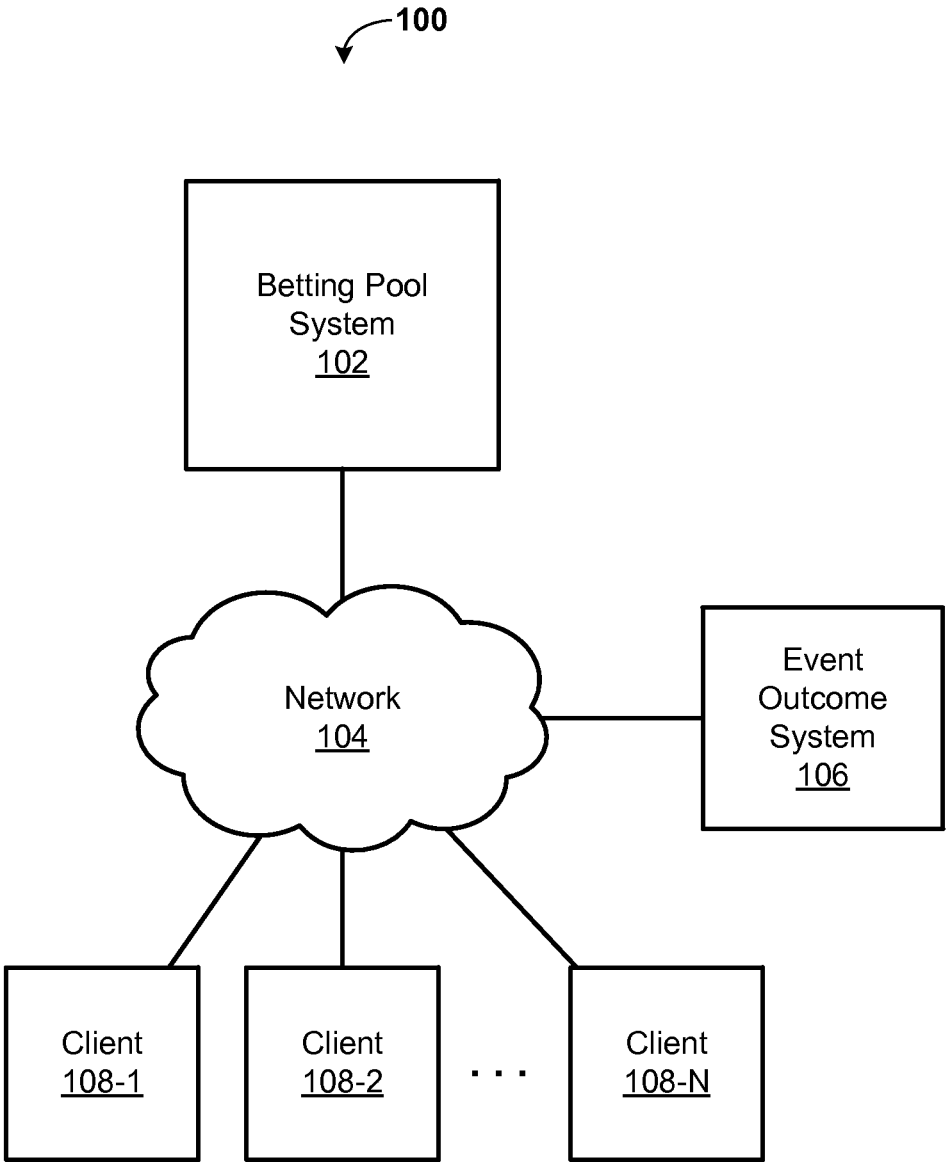
FIG. 1 is a block diagram illustrating an example environment that includes a betting pool system in accordance with some embodiments.

FIG. 1 is a block diagram illustrating an example environment 100 that includes a betting pool system in accordance with some embodiments. As shown, the exemplary environment 100 comprises a betting pool system 102, a network 104, an event outcome system 106, and client 108-1 through client 108-N (hereafter collectively referred to as clients 108). For some embodiments, the network 104 may facilitate data communication between one or more of the betting pool system 102, the event outcome system 106, and the clients 108. One or more of the betting pool system 102, the event outcome system 106, and clients 108 may be implemented using one or more digital devices, each of which may be similar to the one described and depicted with respect to FIG. 5. Additionally, one or more of the betting pool system 102 or the event outcome system 106 may comprise of one or more servers, which may be operating on or implemented using one or more cloud-based services (e.g., System-as-a-Service [SaaS]).

The betting pool system 102 may be configured to implement the functions and features of various embodiments described herein. For example, the betting pool system 102 may facilitate the establishment, and subsequent maintenance, of a betting pool associated with a plurality of pool participants and associated with a plurality of real-life events scheduled to occur over a time period. The plurality of real-life events may be a series of sports matches (e.g., football matches) of a professional sports league (e.g., NFL) scheduled for a given league season (e.g., 2014-2015 NFL season). As used herein, sports matches will be understood to include exhibition games, regular season games, pre-season games, championships games, sports drafts, and other sports-related events. The betting pool system 102 may associate each participant of the plurality of pool participants with points in a points accounts. The betting pool system 102 may further initialize each of the points accounts with a predetermine amount, such that each pool participant in the betting pool starts with equal standing before the plurality of real-life events (e.g., sports matches) commence. By accessing the betting system 102, each pool participant may wager points, from their respective points account, on a predicted outcome with respect to one or more of the real-life events associated with the betting pool. For some embodiments, points wagers on a given real-life event must occur before the real-life event commences. Additionally, for some embodiments, each participant in the betting pool must provide a minimum points wager for each of the real-life events associated with the betting pool. In this way, pool participants must actively participate in the betting pool (e.g., place wagers) or eventually be eliminated from the betting pool (e.g., pool participant ends up with a points balance of zero or less than the minimum points wager).

For some embodiments, the betting pool system 102 may be configured to receive, from one or more pool participants, a first points wager on their respective predicted outcomes for a first real-life event of the plurality of real-life events associated with the betting pool. Eventually, the betting pool system 102 may receive a first actual outcome for the first real-life event (e.g., from the event outcome system 106) and update the points balance in the points account for one or more pool participants based on the first points wager and on the first actual outcome of the first real-life event. In certain embodiments, when a pool participant's predicted outcome for a given real-life event correctly matches the actual outcome for the given real-life event, the pool participant may receive a reward based on their respective points wager. In some such embodiments, when a pool participant's predicted outcome for a given real-life event does not correctly match the actual outcome for the given real-life event, the pool participant may lose points based on their respective points wager. Depending on the embodiment, any points reward may be credited to the pool participant's points account, and any points loss may be charged to (e.g., deducted from) the pool participant's points account. For certain embodiments, the points rewarded to a pool participant for an accurately predicted outcome is equal to the pool participant's points wager (e.g., payout of 2 to 1). For particular embodiments, the points rewarded to a pool participant for an accurately predicted outcome varies between different real-life events (e.g., 3 to 1 payout for particular sports matches). For various embodiments, the points rewarded by the betting pool system 102 to a pool participant is auto-generated by the betting pool 102, and is not provided from the points wagered (and lost) by other pool participants in bettering pool.

In some embodiments, the betting pool system 102 limits a pool participant's points wager to the points available in their respective points account when the first points wager is received. Depending on the embodiment, the betting pool system 102 may permit pool participants to enter a points wager, or change a points wager, for a particular real-life event associated with the betting pool any time before the particular real-life event has commenced. Additionally, depending on the embodiment, when the betting pool system 102 is limiting a pool participant's points wager with respect to a real-life event, the betting pool system 102 may take into consideration all points wager still pending for the pool participant, thereby limiting sum of all pending points wagers to the points currently available in the pool participant's points account.

At end of the betting pools time period (e.g., once all the real-time events have concluded), the betting pool system 102 may identify, from the plurality of pool participants, a set of pool participant winners (e.g., $1^{st}$, $2^{nd}$, and $3^{rd}$ place winners) based on the points balance in each pool participant's points account.

Depending on the embodiment, the betting system 102 may be part of larger fantasy sports system (e.g., a fantasy sports website, such as one provided by the NFL, ESPN®, and Yahoo®), whereby the betting system 102 enables the larger fantasy sports system to provide an alternative format for playing fantasy sports for a fantasy sports season. The alternative format for playing fantasy sports can take the place of, or be used in conjunction with, traditional forms of playing fantasy sports provided by the larger fantasy sports system.

The event outcome system 106 may be configured to provide an actual outcome for a given real-life event. In particular embodiments, the event outcome system 106 provides the betting pool system 102 with the actual outcomes of real-life events associated with a betting pool being managed by the betting pool system 102. The event outcome system 106 may provide the betting pool system 102 with actual outcomes of real-time events at or near real-time, and may provide the actual outcomes as a data stream of information. In certain embodiments, the event outcome system 106 provides a news feed that the betting pool system 102 can use to determine the actual outcomes of particular real-life events. For example, where the betting pool is associated with a plurality of sports matches (e.g., series of baseball games), the event outcome system 106 may provide betting pool system 102 with a sports news feed with the outcome of such sports matches. Depending on the embodiments, the outcome of sports matches can relate to the winner of the sports match, the performance of individual sports players involved in the sports matches (e.g., player statistics), or performance of sports team (e.g., team statistics). One or more components of the event outcome system 106 may be implemented by one or more third-party services (e.g., news services) provided in commonly used data formats (e.g., RSS feeds, web services, JSON objects, etc.).

The clients 108 may be any form of computing device capable of receiving user input (e.g., configured to facilitate interaction between a betting pool participant and the betting pool system 102), capable of displaying a client user interface (e.g., configured to facilitate a betting pool participant to access the betting pool system 102), and capable of communicating with the betting pool system 102 over one or more of the communication connections over the network 104. Such computing devices may include a mobile phone, a tablet computing device, a laptop, a desktop computer, personal digital assistant, a portable multi-media player, or any other type of network accessible user device known to those of skill in the art.

Each of the clients 108 may be configured to communicatively connect with the betting pool system 102 and be provided with access to various functionalities provided by the betting pool system 102. For example, by way of one of the clients 108, a user may establish a betting pool in association with a plurality of real-life events (e.g., betting pool administrator), and a user may join a betting pool as a pool participant. For some embodiments, a user joins the betting pool by paying an entry fee (e.g., buy in for the betting pool). Through one or more of the clients 108, a pool participant may submit one or more predicted outcomes for the plurality of real-life events associated with the betting pool, and the pool participant may submit one or more points wagers (or changes in points wagers) in association the plurality of real-life events.

Figure 2:
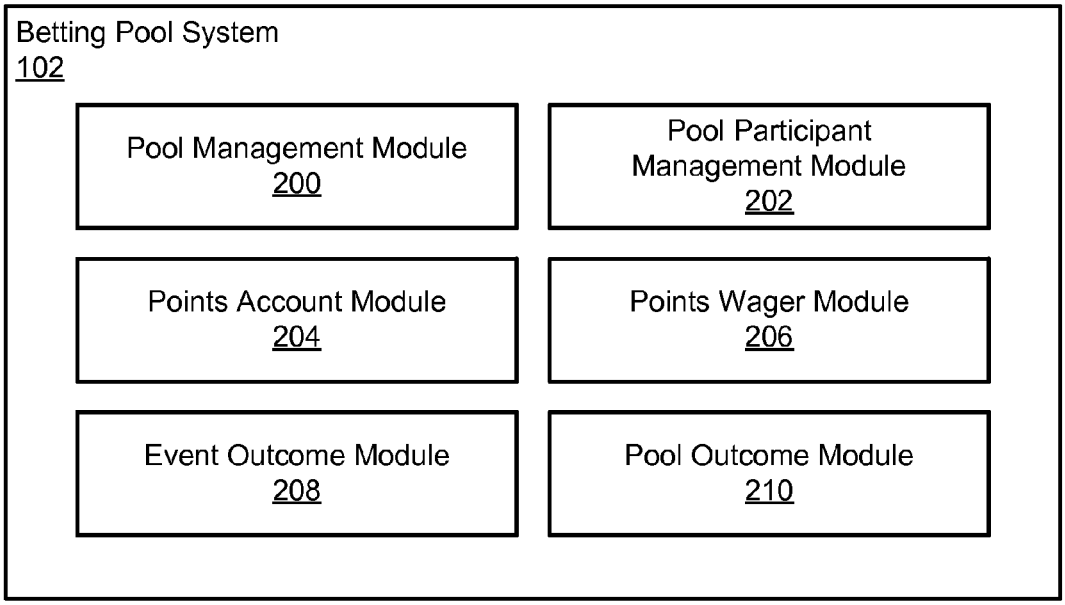
FIG. 2 is a block diagram illustrating an example betting pool system in accordance with some embodiments.

FIG. 2 is a block diagram illustrating an example betting pool system 102 in accordance with some embodiments. In FIG. 2, the betting pool system 102 comprises a pool management module 200, a pool participant management module 202, a points account module 204, a points wager module 206, an event outcome module 208, and a pool outcome module 210. Those skilled in the art will appreciate that the composition of the betting pool system 102 may vary between different embodiments. For some embodiments, one or more of the components of the betting pool system 102, such as the pool management module 200, are implemented using a digital device, and that digital device may be similar to the one described and depicted with respect to FIG. 5.

The pool management module 200 may be configured to establish, maintain, or manage a betting pool in association with a plurality of events scheduled to occur over a period of time. The pool management module 200 may enable a pool administrator (e.g., accessing the betting pool system 102 via one of the client 108) to initiate the creation of a betting pool to be maintained by the betting pool system 102, and to enter the specific parameters of the betting pool. Examples parameters that may be entered for a betting pool can include, without limitation, a name of the betting pool, a set of real-life events associated with the betting pool, a plurality of pool participants to be associated with the betting pool, the time period (e.g., duration) for the betting pool, initial points for pool participants, how one or more winners are selected at the end of the betting pool time period, wager settings (e.g., minimum wagers, ante, required participation, etc.), settings relating to how pool participants can interact with the betting pool, and the like. The set of real-life events that a pool administrator can select to associate with the betting pool may be predetermined by the betting pool system 102, the betting pool may be defined by the pool administrator, or both. The plurality of pool participants that the pool administrator associates with the betting pool may be permitted to join when they access the betting pool system 102 (e.g., via one of the client 108), and may further receive a message (e.g., via e-mail) from the betting system 102 to inviting them to join the betting pool. For some embodiments, joining the betting pool involves collecting information from candidate pool participant, such as contact information, login information, user preferences, and like, before the candidate pool participant becomes an enrolled pool participant.

The pool participant management module 202 may be configured to facilitate management of pool participants with respect to a betting pool. Functions performed by the pool participant management module 202 may include processes relating to pool participants joining the betting pool, sending invitations to individuals to join the betting pool (e.g., based on the pool administrator's settings), and management of pool participant's preferences. As described herein, a pool participant's preferences may assist the betting system 102 in determining (e.g., auto-generating), for the pool participant, a predicted outcome for a given real-life event associated with the betting pool. The betting system 102 may do so when the pool participant fails to provide a predicted outcome for the given real-life event before it begins. Likewise, the pool participant's preferences may assist the betting system 102 in determining (e.g., auto-generating), for the pool participant, a wager for a given real-life event associated with the betting pool. The betting system 102 may do so when the pool participant fails to provide a wager for the given real-life event before it begins. The pool participant's preferences may indicate a default predicted outcome to be selected by the betting system 102 when the pool participant fails to provide one, and may indicate a default wager (e.g., minimum wager or a predetermined wager higher than the minimum wager) when the pool participant fails to provide one.

The points account module 204 may be configured to manage a plurality of points accounts in association with pool participants associated with a betting pool. In particular, the points account module 204 may maintain a points balance in each points account associated with a pool participant, and may credit or deduct points from the points accounts based on wagers and outcomes of real-life events associated with the betting pool. Such credits and deductions of points may occur as the time period for the betting pool progresses and the scheduled real-life events, associated with the betting pool, take place. In accordance with some embodiments, where a given pool participant is involved more than one betting pool, a pool participant's points account is unique for each betting pool in which the pool participant is involved. With respect to a given betting pool, the points account module 204 is responsible for establishing, initializing, and associating a points account with each pool participant that is associated with the given betting pool.

The points wager module 206 may be configured to manage pool participant wagers on predicted outcomes for a plurality of real-life events associated with a betting pool. In particular, the points account module 204 may receive wagers, or wager changes, for a given real-life event associated with the betting pool, and may receive such wagers or wager changes before the given real-life event begins. After a given real-life event has commenced, the points wager module 206 may restrict or prevent the pool participant from modifying their wager with respect to the given real-life event. A wager for a given real-life event may be considered committed once the given real-life event has commenced. When a pool participant submits a wager for the given real-life event, the points wager module 206 may limit such wagers based on the current points balance associated with the pool participant, and may further limit such wagers based on the pool participant's total amount of wagers already committed to other real-life events.

The event outcome module 208 may be configured to obtain or otherwise receive actual outcomes for a plurality of real-life events associated with a betting pool. For some embodiments, the event outcome module 208 obtains or receives actual outcomes from two or more different information sources. Examples of information sources can include, without limitation, news feeds, sports new feeds, blogs, organization websites, social media (e.g., Facebook® or Twitter®), and the like. The event outcome module 208 may use different information sources for based on the type of real-life event associated with the betting pool. For example, where a real-life event relates to sports (e.g., sports match), the event outcome module 208 may obtain actual outcomes from a sports news feed. In another example, where the real-life event relates to entertainment award nominations, the event outcome module 208 may obtain actual outcomes from one or more of an entertainment news feed and a social media website.

The pool outcome module 210 may be configured to identify one or more pool participant winners when a plurality of real-life events associated with a betting pool have concluded. To do so, the pool outcome module 210 may access and review the points account balance associated with each pool participant associated with the betting pool. Based on the parameters of the betting pool (e.g., as defined through the pool management module 200), the pool outcome module 210 may identify (e.g., declare) one pool participant the winner of the betting pool or may identify two or more pool participants as the winners (e.g., $1^{st}$, $2^{nd}$, and $3^{rd}$ place winners). The pool outcome module 210 may further provide a ranking of pool participants at the conclusion of the betting pool.

Figure 3:
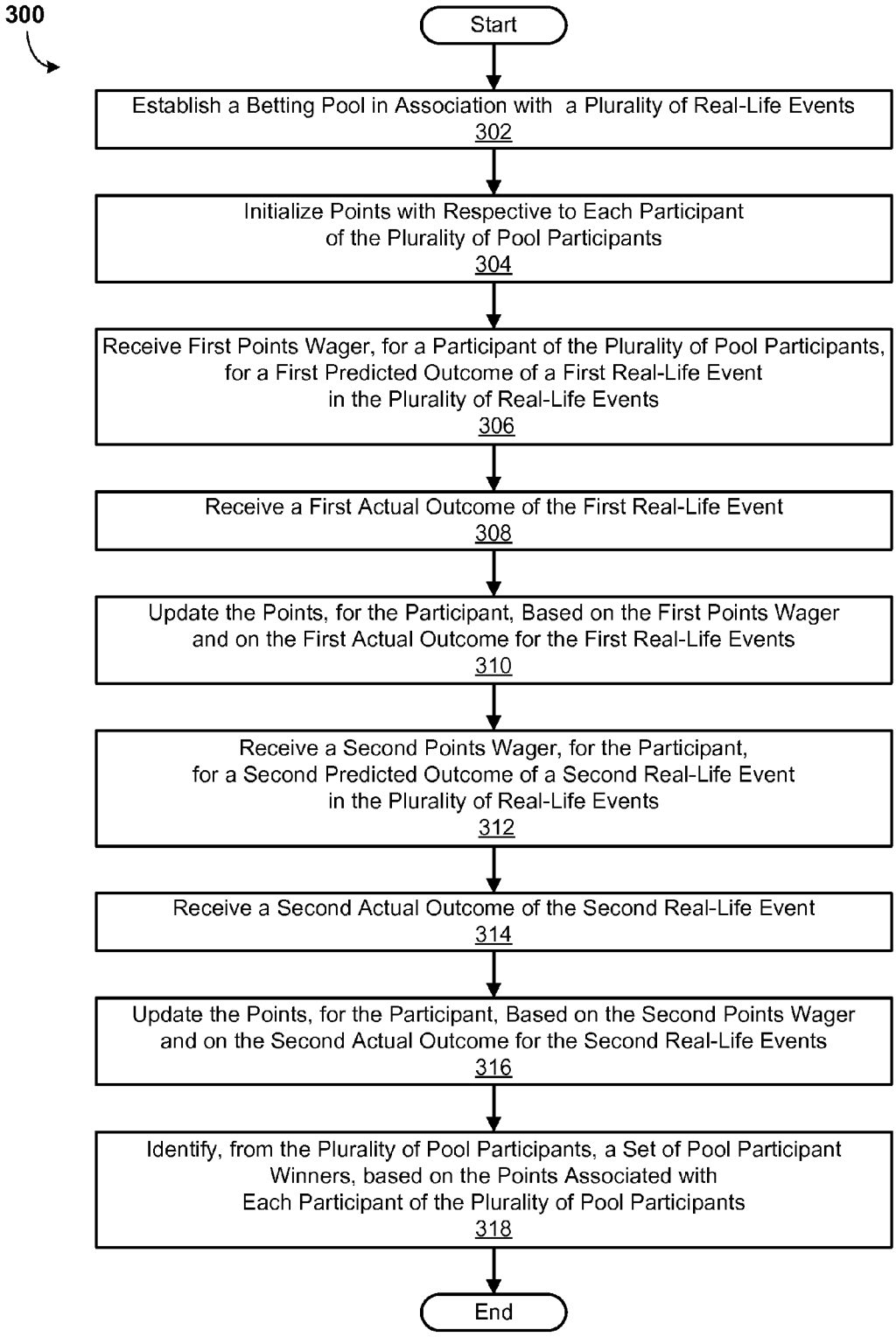
FIG. 3 is a flow diagram illustrating an example method for calibrating a power amplifier in accordance with some embodiments.

FIG. 3 is a flow diagram illustrating an example method for calibrating a power amplifier in accordance with some embodiments. The method 300 begins at step 302 with the pool management module 200 establishing a betting pool in association with a plurality of real-life events. For some embodiments, the betting pool is associated with a plurality of pool participants, and each participant in the plurality of pool participants is associated with a set of points. Depending on the embodiment, the set of points associated with a given participant may be maintained in a points account associated with the given participant. At step 304, the points account module 204 initializes points with respect to each participant of the plurality of pool participants. At step 306, the points wager module 206 receives, for a participant of the plurality of pool participants, a first points wager for a first predicted outcome with respect to a first real-life event in a plurality of real-life events. At step 308, the event outcome module 208 receives a first actual outcome of the first real-life event. At step 310, the points account module 204 updates the points, for the participant, based on the first points wager and on the first actual outcome for the first real-life events. At step 312, the points wager module 206 receives, for the participant of the plurality of pool participants, a second points wager for a second predicted outcome with respect to a second real-life event in a plurality of real-life events. At step 314, the event outcome module 208 receives a second actual outcome of the first real-life event. At step 316, the points account module 204 updates the points, for the participant, based on the second points wager and on the second actual outcome for the first real-life events. Eventually, at step 318, the pool outcome module 210 identifies, from the plurality of pool participants, a set of pool participant winners, based on the points associated with each participant of the plurality of pool participants.

Though the steps of the method 300 may be depicted and described in a certain order, those skilled in the art will appreciate that the order in which the steps are performed may vary between different embodiments. Additionally, those skilled in the art will appreciate that the components described above with respect to the method 300 are merely examples of components that may be used with the method 300, and that other components may also be utilized in some embodiments.

FIGS. 4A-4D are diagrams illustrating an example betting pool conducted in accordance with some embodiments. As described herein, the example betting pool may be associated with a plurality of pool participants, a plurality of real-life events, and points wagers each participant of the plurality of pool participants makes with respect to outcomes of the plurality of real-life events. In FIGS. 4A-4D, tables 400*a*-400*d* (hereafter collectively referred to as tables 400) depict actual outcomes for real-life events associated with the example betting pool and scheduled to occur over a time period spanning from time slot $t_0$ to time slot $t_m$. In FIGS. 4A-4D, tables 402*a*-402*d* (hereafter collectively referred to as tables 402) depict participant P1's points wagers for P1's predicted outcomes of the real-life events associated with the example betting pool and scheduled to occur over the time period spanning from time slot $t_0$ to time slot $t_m$. In FIGS. 4A-4D, tables 404*a*-404*d* (hereafter collectively referred to as tables 404) depict participant P1's points account, in association with the example betting pool, over a time period spanning from time slot $t_0$ to time slot $t_m$. Each of FIGS. 4A-4D illustrates tables 400, 402, and 404 at different time instances, during a time period spanning from time slot $t_0$ to time slot $t_m$, as the example betting pool is conducted in accordance with various embodiments described herein.

Figure 4A:
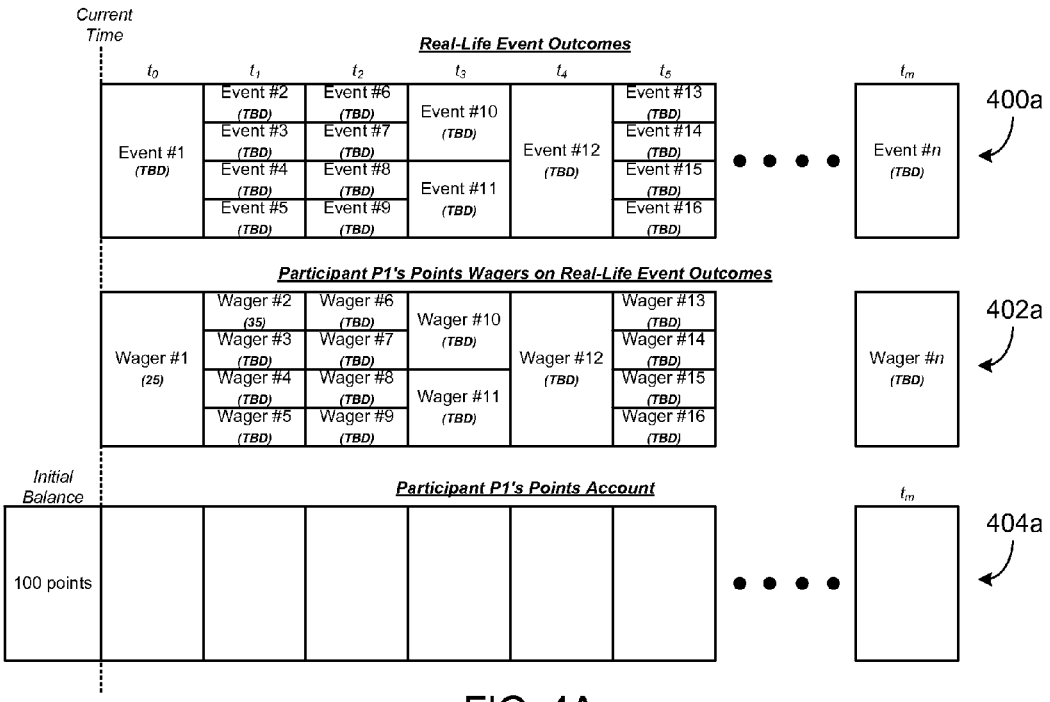
FIGS. 4A-4D are diagrams illustrating an example betting pool conducted in accordance with some embodiments.

As shown in FIG. 4A, tables 400*a*, 402*a*, and 404*a* are illustrated at a time instance at the beginning of the time period spanning from time slot $t_0$ to time slot $t_m$. In table 400*a*, the actual outcomes for events #1-n have yet to be determined. Table 402*a* illustrates that participant P1 (hereafter, P1) has placed a points wager (Wager #1) of 25 points for P1's predicted outcome with respect to event #1. Table 404*a* illustrates that P1's points account has an initial balance of 100 points.

Figure 4B:
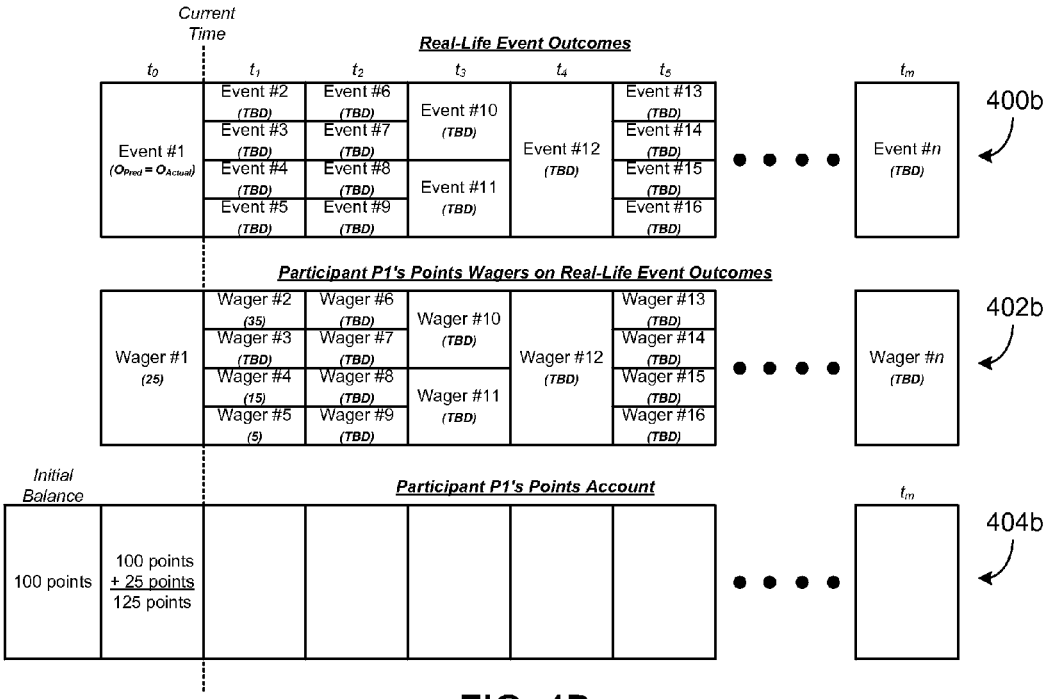

As illustrated in FIG. 4B, tables 400*b*, 402*b*, and 404*b* are illustrated at a time instance after time slot $t_0$. In table 400*b*, the actual outcome of event #1 is shown to be the same as P1's predicted outcome of event #1. As a result, table 404*b* illustrates that P1's points account has been credited by 25 points (Wager #1) for P1's correct outcome prediction with respect to event #1. Table 402*b* illustrates that P1 has placed a points wager (Wager #2) of 35 points for P1's predicted outcome with respect to event #2, a points wager (Wager #4) of 15 points for P1's predicted outcome with respect to event #4, and a points wager (Wager #5) of 5 points for P1's predicted outcome with respect to event #5. Table 402*b* also illustrates that P1 has yet to place a points wager for event #4. In accordance with some embodiments, if P1 fails to provide a points wager for event #3 before time slot $t_1$ begins, systems and methods described herein can automatically enter a wager (e.g., a minimum wager of 2 points) for event #3 on behalf of P1.

As described herein, in certain embodiments, each pool participant is required to provide an ante (e.g., a forced points wager of 2 points) on each real-life event (e.g., event #3) in the set of real-life event (e.g., events #1 through #n). In this way, various embodiments ensure that those pool participants who fail to remain active in the betting pool (e.g., actively wagering on the predicted outcomes of events #1 through #n) are eventually eliminated (anted-out) when their balance of points reaches minimum threshold of points (e.g., reaches zero or reaches a balance below the ante amount). The systems and methods may make the ante automatically for an individual pool participant (e.g., for one or more of the events #1 through #n) if that pool participant fails to submit a wager or fails to submit a minimum wager before a particular time (e.g., before the beginning of each individual event #1 through #n).

Figure 4C:
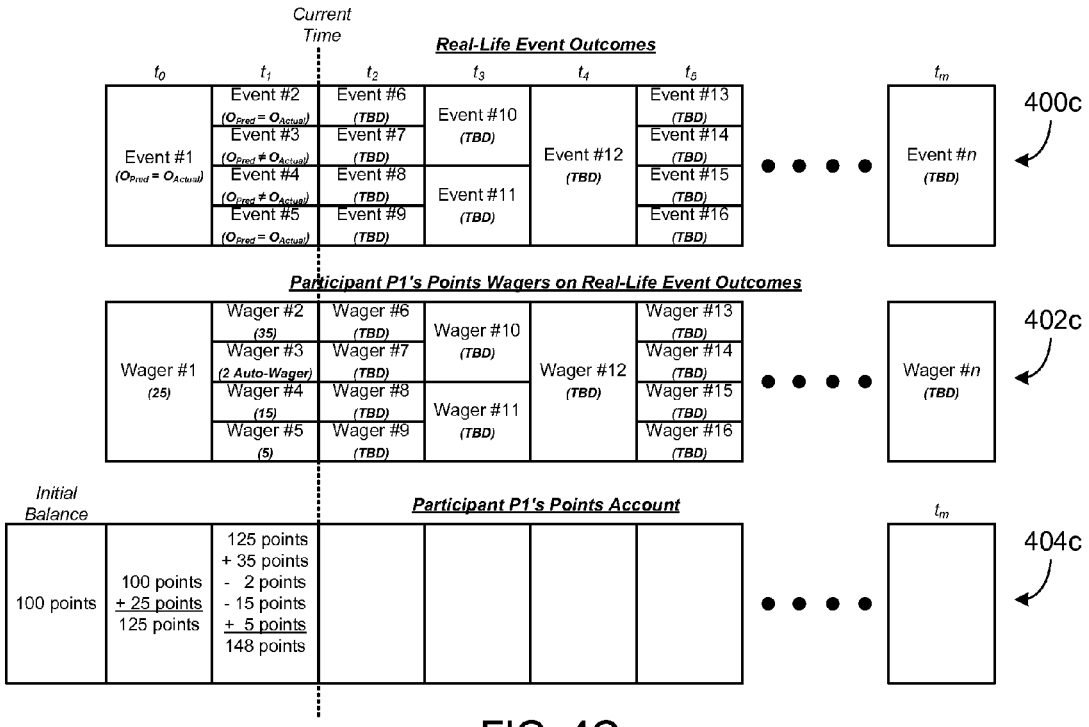

As illustrated in FIG. 4C, tables 400*c*, 402*c*, and 404*c* are illustrated at a time instance after time slot $t_1$. In table 400*c*, the actual outcome of events #2 and #5 are shown to be the same as P1's predicted outcomes of events #2 and #5, and the actual outcome of events #3 and #4 are shown not to be the same as P1's predicted outcomes of events #3 and #4. As a result, table 404*c* illustrates that P1's points account has been credited by 35 points (Wager #2) for P1's correct outcome prediction with respect to event #2, has been charged 2 points (Wager #3) for P1's incorrect outcome prediction with respect to event #3, has been charged 15 points (Wager #4) for P1's incorrect outcome prediction with respect to event #4, and has been credited by 5 points (Wager #5) for P1's correct outcome prediction with respect to event #5. Table 402*c* illustrates how systems or methods described herein may automatically enter a points wager (Wager #3) of 2 points, on behalf of P1, for P1's predicted outcome with respect to event #3, and may do so when P1 fails to provide a points wager for event #3 before time slot $t_1$ begins.

Figure 4D:
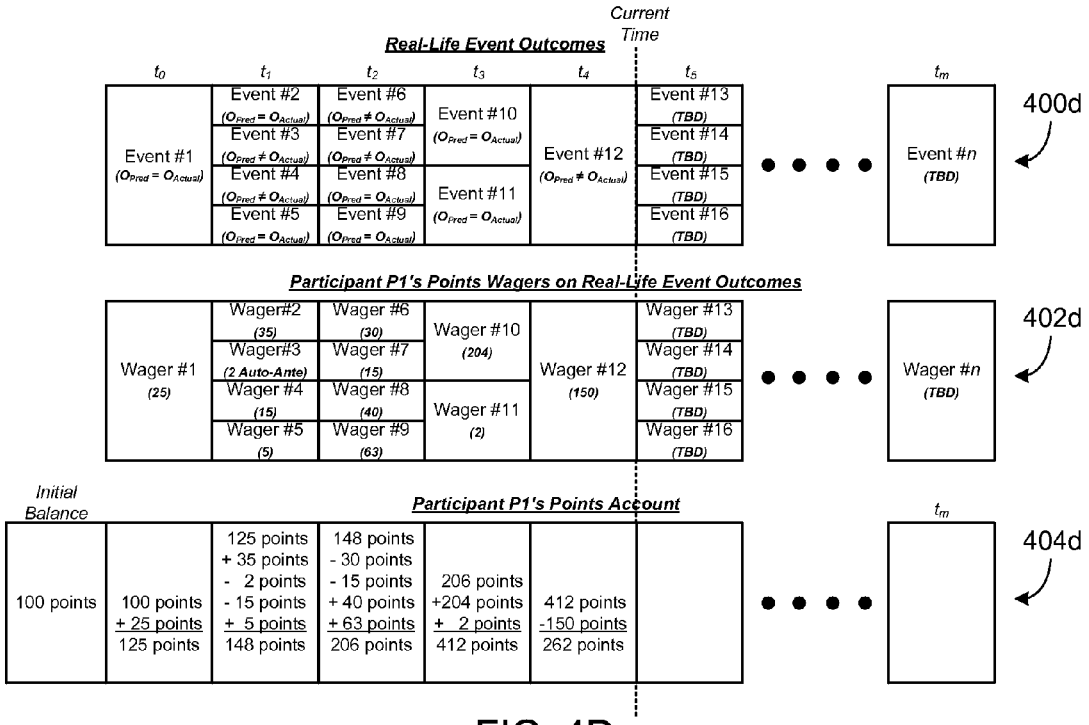

As illustrated in FIG. 4D, tables 400*d*, 402*d*, and 404*d* are illustrated at a time instance after time slot $t_4$. In table 400*d*, the actual outcome of events #8, #9, #10 and #11 are shown to be the same as P1's predicted outcomes of events #8, #9, #10 and #11, and the actual outcome of events #6, #7 and #12 are shown not to be the same as P1's predicted outcomes of events #6, #7 and #12. As a result, table 404*d* illustrates that in time slot $t_2$, P1's points account has been charged 30 points (Wager #6) for P1's incorrect outcome prediction with respect to event #6, has been charged 15 points (Wager #7) for P1's incorrect outcome prediction with respect to event #7, has been credited by 40 points (Wager #8) for P1's correct outcome prediction with respect to event #8, has been credited by 63 points (Wager #9) for P1's correct outcome prediction with respect to event #9. Table 404*d* illustrates that in time slot $t_3$, P1's points account has been credited by 204 points (Wager #10) for P1's correct outcome prediction with respect to event #10, and has been credited by 2 points (Wager #11) for P1's correct outcome prediction with respect to event #11. Table 404*d* also illustrates that in time slot $t_4$, P1's points account has been charged 150 points (Wager #12) for P1's incorrect outcome prediction with respect to event #12. Table 402*d* illustrates how for some embodiments, the systems and methods described herein may prevent P1 from wagering more points than are in P1's points account. For example, since P1's points account has a balance of 206 points in time slot $t_2$, as shown in table 404*d*, the systems and methods described herein may limit P1's wagering in time slot $t_3$ to 206 points, as shown in table 402*d*. In accordance with some embodiments, at the end of time slot $t_m$, a set of pool participant winners is selected from a plurality of pool participants, that includes P1, based on the points account associated with each pool participant.

Figure 5:
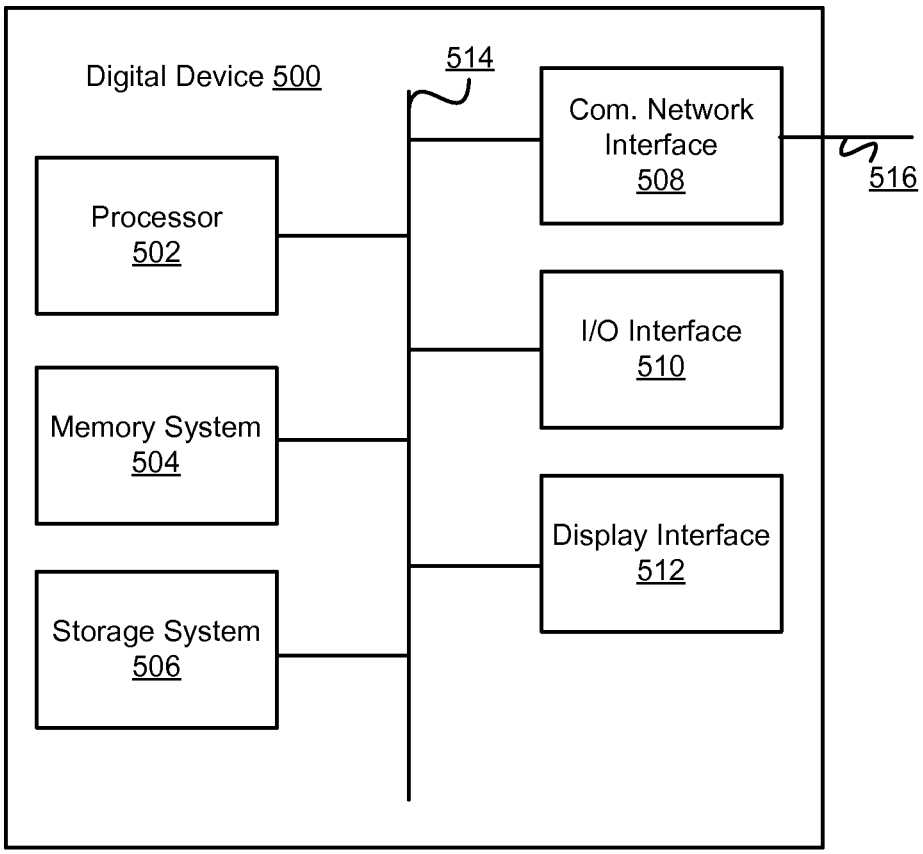
FIG. 5 is a block diagram illustrating an example digital device according to some embodiments.

FIG. 5 is a block diagram illustrating an example digital device 500 according to some embodiments. The digital device 500 comprises a processor 502, a memory system 504, a storage system 506, a communication network interface 508, an I/O interface 510, and a display interface 512 communicatively coupled to a bus 514. The processor 502 may be configured to execute executable instructions (e.g., programs). In some embodiments, the processor 502 comprises circuitry or any processor capable of processing the executable instructions.

The memory system 504 is any memory configured to store data. Some examples of the memory system 504 are storage devices, such as RAM or ROM. The memory system 504 may comprise the RAM cache. In various embodiments, data is stored within the memory system 504. The data within the memory system 504 may be cleared or ultimately transferred to the storage system 506.

The storage system 506 is any storage configured to retrieve and store data. Some examples of the storage system 506 are flash drives, hard drives, optical drives, or magnetic tape. In some embodiments, the digital device 500 includes a memory system 504 in the form of RAM and a storage system 506 in the form of flash data. Both the memory system 504 and the storage system 506 comprise computer readable media that may store instructions or programs that are executable by a computer processor including the processor 502.

The communication network interface (com. network interface) 508 may be coupled to a data network via the link 516. The communication network interface 508 may support communication over an Ethernet connection, a serial connection, a parallel connection, or an ATA connection, for example. The communication network interface 508 may also support wireless communication (e.g., 802.11 a/b/g/n, WiMAX). It will be apparent to those skilled in the art that the communication network interface 508 may support many wired and wireless standards.

The optional input/output (I/O) interface 510 is any device that receives input from the user and output data. The optional display interface 512 is any device that may be configured to output graphics and data to a display. In one example, the display interface 512 is a graphics adapter.

It will be appreciated by those skilled in the art that the hardware elements of the digital device 500 are not limited to those depicted in FIG. 5. A digital device 500 may comprise more or less hardware elements than those depicted. Further, hardware elements may share functionality and still be within various embodiments described herein. In one example, encoding or decoding may be performed by the processor 502 or a co-processor located on a GPU.

One or more functions may be stored on a storage medium such as a computer readable medium. The instructions can be retrieved and executed by a processor. Some examples of instructions are software, program code, and firmware. Some examples of storage medium are memory devices, tape, disks, integrated circuits, and servers. The instructions are operational when executed by the processor to direct the processor to operate in accord with some embodiments. Those skilled in the art are familiar with instructions, processor(s), and storage medium.

As used herein, the term "set" may refer to any collection of elements, whether finite or infinite. The term subset may refer to any collection of elements, wherein the elements are taken from a parent set; a subset may be the entire parent set. The term proper subset refers to a subset containing fewer elements than the parent set.

Additionally, it will be appreciated that a "module" may comprise software, hardware, firmware, and/or circuitry. In one example one or more software programs comprising instructions capable of being executable by a processor may perform one or more of the functions of the modules described herein. In another example, circuitry may perform the same or similar functions. Alternative embodiments may comprise more, less, or functionally equivalent modules and still be within the scope of present embodiments. For example, the functions of the various modules may be combined or divided differently.

Throughout the entirety of the present disclosure, use of the articles "a" or "an" to modify a noun may be understood to be used for convenience and to include one, or more than one of the modified noun, unless otherwise specifically stated.

Various embodiments are described herein as examples. It will be apparent to those skilled in the art that various modifications may be made and other embodiments can be used.

I claim:

1. A method comprising:

establishing, by a digital device, a betting pool, the betting pool being associated with a plurality of pool participants and with a plurality of real-life events scheduled to occur over a time period;

associating, by the digital device, each participant of the plurality of pool participants with points in a points account; and for a first participant of the plurality of pool participants:

receiving, by the digital device, a first points wager on a first predicted outcome of a first real-life event of the plurality of real-life events, the first points wager being for at least a first subset of the points in the points account, updating, by the digital device, the points in the points account based on the first points wager and on a first actual outcome of the first real-life event, receiving, by the digital device, a second points wager on a second predicted outcome of a second real-life event of the plurality of real-life events, the second points wager being for at least a second subset of the points in the points account, and updating, by the digital device, the points in the points account based on the second points wager and on a second actual outcome of the second real-life event.

2. The method of claim 1, wherein the plurality of real-life events include real-life sports matches.

3. The method of claim 2, wherein the time period is a sports season associated with the real-life sports matches.

4. The method of claim 2, wherein the real-life sports matches are associated with football, basketball, baseball, hockey, soccer, golf, or tennis.

5. The method of claim 1, wherein the first points wager or the second points wager comprises an ante.

6. The method of claim 1, further comprising identifying, by the digital device and from the plurality of pool participants, a set of pool participant winners based on the points associated with each participant of the plurality of pool participants.

7. The method of claim 6, wherein the identifying the set of betting pool winners occurs at or after the time period has expired.

8. The method of claim 1, wherein the updating the points in the points account based on the first points wager and on the first actual outcome of the first real-life event comprises depositing points to or withdrawing deposits from the points account based on the first points wager by the first pool participant.

9. The method of claim 1, wherein the first real-life event ends before the second real-life event begins, and the second points wager is based on the points in the points account after the updating the points in the points account based on the first points wager.

10. The method of claim 1, wherein the second real-life event begins substantially simultaneously to the first real-life event.

11. The method of claim 1, wherein the second real-life event begins before the first real-life event ends.

12. The method of claim 1, wherein the first points wager is limited to the points in the points account when the first points wager is received, and wherein the second points wager is limited to the points in the points account when the second points wager is received.

13. The method of claim 1, wherein the first real-life event is a first sports match, and the first predicted outcome and the first actual outcome relate to a first winner of the first sports match, a first player performance of a first sports player participating in the first sports match, or a first team performance of a first team participating in the first sports match.

14. The method of claim 13, wherein the second real-life event is a second sports match, and the second predicted outcome and the second actual outcome relate to a second winner of the second sports match, a second player performance of a second sports player participating in the second sports match, or a second team performance of a second team participating in the second sports match.

15. The method of claim 1, wherein the first points wager is generated automatically if the participant fails to provide the first points wager for the first real-life event.

16. The method of claim 1, wherein the first points wager is generated automatically if the given pool participant fails to provide the first predicted outcome for the first real-life event.

17. The method of claim 1, further comprising receiving, by the digital device, the first actual outcome for the first real-life event.

18. The method of claim 17, further comprising receiving, by the digital device, the second actual outcome for the second real-life event.

19. A system comprising:

a digital device;

means for causing the digital device to establish a betting pool, the betting pool being associated with a plurality of pool participants and with a plurality of real-life events scheduled to occur over a time period;

means for causing the digital device to associate each participant of the plurality of pool participants with points in a points account; and for a first participant of the plurality of pool participants:

means for causing the digital device to receive a first points wager on a first predicted outcome of a first real-life event of the plurality of real-life events, the first points wager being for at least a first subset of the points in the points account, means for causing the digital device to update the points in the points account based on the first points wager and on a first actual outcome of the first real-life event, means for causing the digital device to receive a second points wager on a second predicted outcome of a second real-life event of the plurality of real-life events, the second points wager being for at least a second subset of the points in the points account, and means for causing the digital device to update the points in the points account based on the second points wager and on a second actual outcome of the second real-life event.

20. A system comprising:

a digital device; and a memory storing instructions configured to instruct the digital device to perform the operations of:

establishing a betting pool, the betting pool being associated with a plurality of pool participants and with a plurality of real-life events scheduled to occur over a time period;

associating each participant of the plurality of pool participants with points in a points account; and for a first participant of the plurality of pool participants:

receiving a first points wager on a first predicted outcome of a first real-life event of the plurality of real-life events, the first points wager being for at least a first subset of the points in the points account, updating the points in the points account based on the first points wager and on a first actual outcome of the first real-life event, receiving a second points wager on a second predicted outcome of a second real-life event of the plurality of real-life events, the second points wager being for at least a second subset of the points in the points account, and updating the points in the points account based on the second points wager and on a second actual outcome of the second real-life event.

* * * * *